US005454228A

United States Patent [19]

Yang et al.

[11] Patent Number: 5,454,228

[45] Date of Patent: Oct. 3, 1995

[54] REFRIGERATION SYSTEM FOR FLUID CHILLING PACKAGES

[75] Inventors: Chung-Yuan Yang; Chin-Hung Lo; Yu-Kun Hung; Mao-Yung Weng; Yie-Zu Hu, all of Hsinchu, Taiwan

[73] Assignee: Industrial Technology Research Institute, Hsinchu, Taiwan, Prov. of China

[21] Appl. No.: 255,946

[22] Filed: Jun. 7, 1994

[51] Int. Cl.[6] ..... F25B 39/04

[52] U.S. Cl. ..... 62/113; 62/503; 62/513; 62/225; 62/506

[58] Field of Search ..... 62/113, 513, 503, 62/506, 512, 222, 224, 225, 174, 509

[56] References Cited

U.S. PATENT DOCUMENTS 4,807,449 2/1989 Helmer ..... 62/503

5,245,833 9/1993 Mei et al. ..... 62/113

5,245,836 9/1993 Lorentzen et al. ..... 62/503 X

*Primary Examiner*—Harry B. Tanner

*Attorney, Agent, or Firm*—Pollock, Vande Sande & Priddy

[57] ABSTRACT

A liquid refrigeration system for providing cooling operations, including an evaporator with its refrigerant outlet connected to a vapor/liquid separator so that refrigerant in the refrigerant conduits in the evaporator may undergo heat exchange in the form of a mixture of vapor and liquid. The compressor of the system outputs high pressure refrigerant vapor which passes through a specially designed condenser before being conveyed to a thermostatic expansion valve at the front end of the inlet of the evaporator. Low-pressure oil-rich liquid refrigerant separated by the vapor/liquid separator first passes through the condenser to become superheated vapor and it is then sent to the suction line of the compressor together with the saturated refrigerant vapor from the vapor/liquid separator. The expansion valve meters the flow rate of system refrigerant and has a temperature sensor which detects the superheat of the low pressure refrigerant vapor leaving the condenser.

7 Claims, 3 Drawing Sheets

REFRIGERATION SYSTEM FOR FLUID CHILLING PACKAGES

FIELD OF THE INVENTION

The present invention relates generally to a refrigeration system, and particularly to a direct expansion type refrigeration system adapted for use in fluid chilling packages (such as water chillers) or the like to produce cooling operations.

BACKGROUND OF THE INVENTION

For fluid chilling packages, the most frequently used systems include two main types, namely, flooded type and direct expansion type. The former is comparatively more complicated and expensive; therefore, unless there is a special requirement for high cooling efficiency, it is often not adopted. The direct expansion type system is less complicated, but its cooling efficiency is consequently lower; therefore, finding out the cause of cooling efficiency in direct expansion type systems and providing a reasonable solution to the problem may offer a refrigeration system which is simple but has high cooling efficiency, and which is suited for use in fluid chilling packages or the like.

FIG. 1 shows a conventional and typical direct expansion type refrigeration system used in, for instance, a water chilling package. The system comprises a thermostatic expansion valve 5; an evaporator 1 connected to the expansion valve 5; a compressor 3 connected to a refrigerant outlet 13 of the evaporator 1; and a heat exchanger 4 which is commonly known as condenser connected to the compressor 3 and the expansion valve 5, wherein the expansion valve 5 has a temperature sensor 15 (such as a bulb) disposed in the vicinity of the refrigerant outlet 13 of the evaporator 1 to detect the superheat at the refrigerant outlet 13 so as to control the flow through the expansion valve 5. The expansion valve 5 conveys the liquid refrigerant in a refrigerant conduit 47 into the evaporator 1; the liquid refrigerant absorbs the heat of the cold water (when used in a water chilling package) during the process of evaporation so that the temperature of the water drops; therefore, the temperature of water passing through the evaporator 1 may be lowered. Relatively, liquid refrigerant passing the refrigerant conduit 12 absorbs the heat of the water so that when it reaches the refrigerant outlet 13 of the evaporator 1, liquid refrigerant is completely evaporated and superheated. The function of the temperature sensor 15 is, as mentioned before, to detect the superheat at the refrigerant outlet 13 of the evaporator 1, thereby regulating the mass flow rate of refrigerant passing through the expansion valve 5. Such a configuration enables the refrigerant at the outlet 13 of the evaporator 1 to be completely evaporated and superheated; otherwise, even if very little liquid refrigerant returns to the suction line 31 of the compressor 3, it may damage the compressor 3.

As is well known, the heat transfer coefficient of vapor is lower than that of two-phase mixture of liquid and vapor; in other words, the heat transfer coefficient of vaporized refrigerant is lower than that of saturated refrigerant. If the refrigerant is prevented to become completely vaporized and superheated in the evaporator, the heat exchange efficiency is undoubtedly increased. This problem has long existed in conventional direct expansion type refrigeration systems and is difficult to overcome.

SUMMARY OF THE INVENTION

Therefore, it is a primary object of the present invention to provide a liquid refrigeration system, having a vapor/liquid separator connected to an outlet of the evaporator for the passage of refrigerant so that the refrigerant in the evaporator need not be completely vaporized, thereby increasing the heat exchange efficiency of the evaporator.

Another object of the present invention is to provide a liquid refrigeration system having a special heat exchange device so that the high pressure refrigerant vapor discharged from the compressor is condensed to liquid in the upper section of the heat exchange device, and in the bottom section of the heat exchange device, the oil-rich liquid refrigerant from the vapor/liquid separator is vaporized inside the tubes of the heat exchange device, and the condensed refrigerant is subcooled in the shell side of the heat exchange device.

A further object of the present invention is to provide a temperature sensor for the expansion valve in a liquid refrigeration system to detect the superheat of oil-refrigerant vapor after heat exchange in the built-in secondary or oil-reparated heat exchanger in the heat exchange device.

In the present invention, the refrigerant conduit of the evaporator passes through a vapor/liquid separator and is then connected to the compressor; therefore, the refrigerant in the evaporator undergoes heat exchange in the form of a mixture of liquid and vapor. A specially designed condenser has one end thereof connected to the expansion valve which is connected to the evaporator, with the other end thereof connected to the discharge port of the compressor. The condenser has cooling water conduit arrangements as in conventional condensers, and it additionally has a built-in secondary heat exchanger connected to the liquid line of the vapor/liquid separator for the vaporization of low pressure oil-rich refrigerant liquid. In this way, the high pressure refrigerant vapor undergoes heat exchange with the cooling water conduit at first, and is condensed to high pressure refrigerant liquid, then the refrigerant liquid undergoes a second heat exchange process in the bottom section of the condenser to become the subcooled refrigerant liquid.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
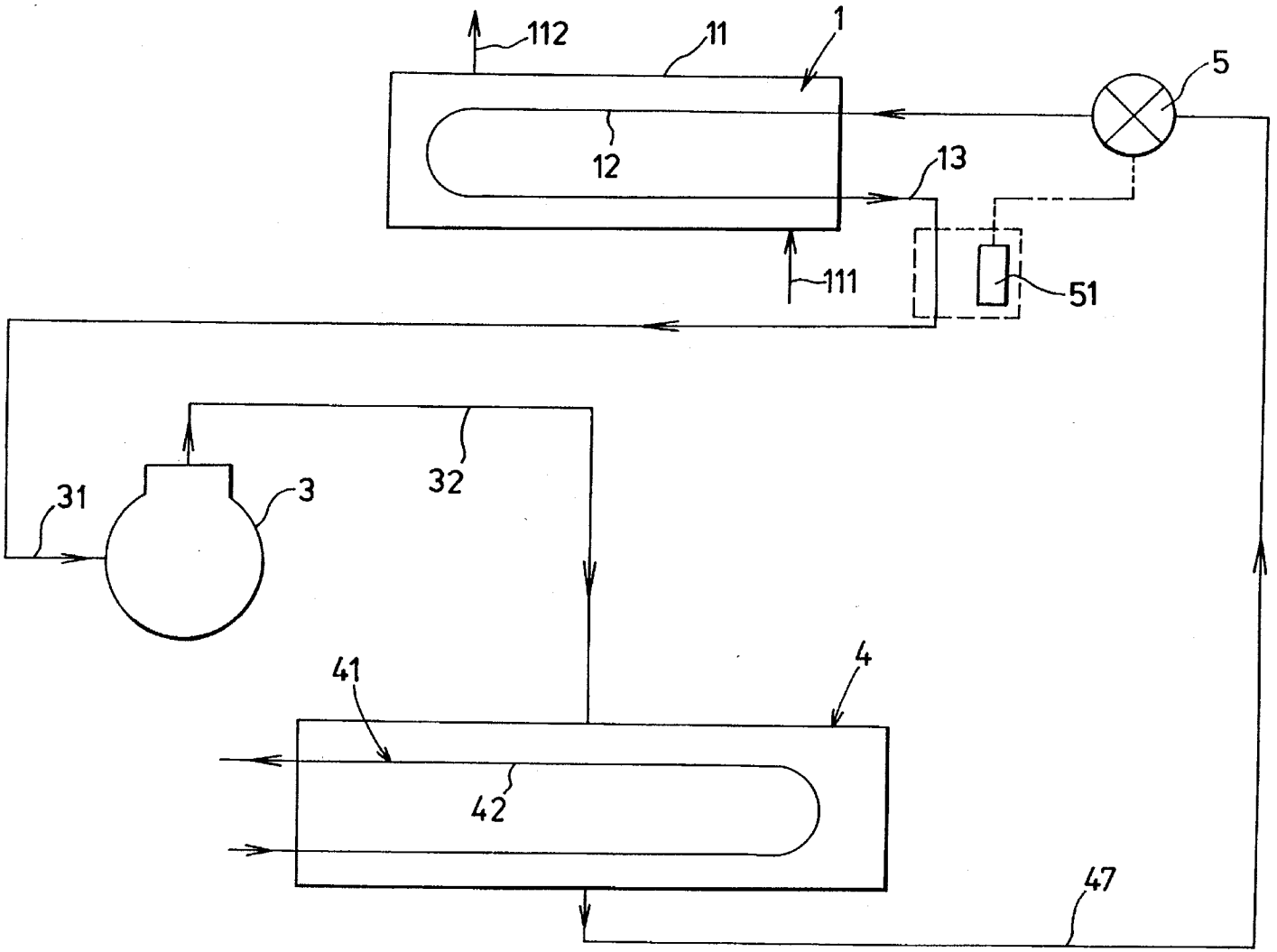
FIG. 1 PRIOR ART
FIG. 1 is a system diagram of the conventional direct expansion type refrigeration system.

FIG. 1 shows a conventional system which was already described hereinabove.

Figure 2:
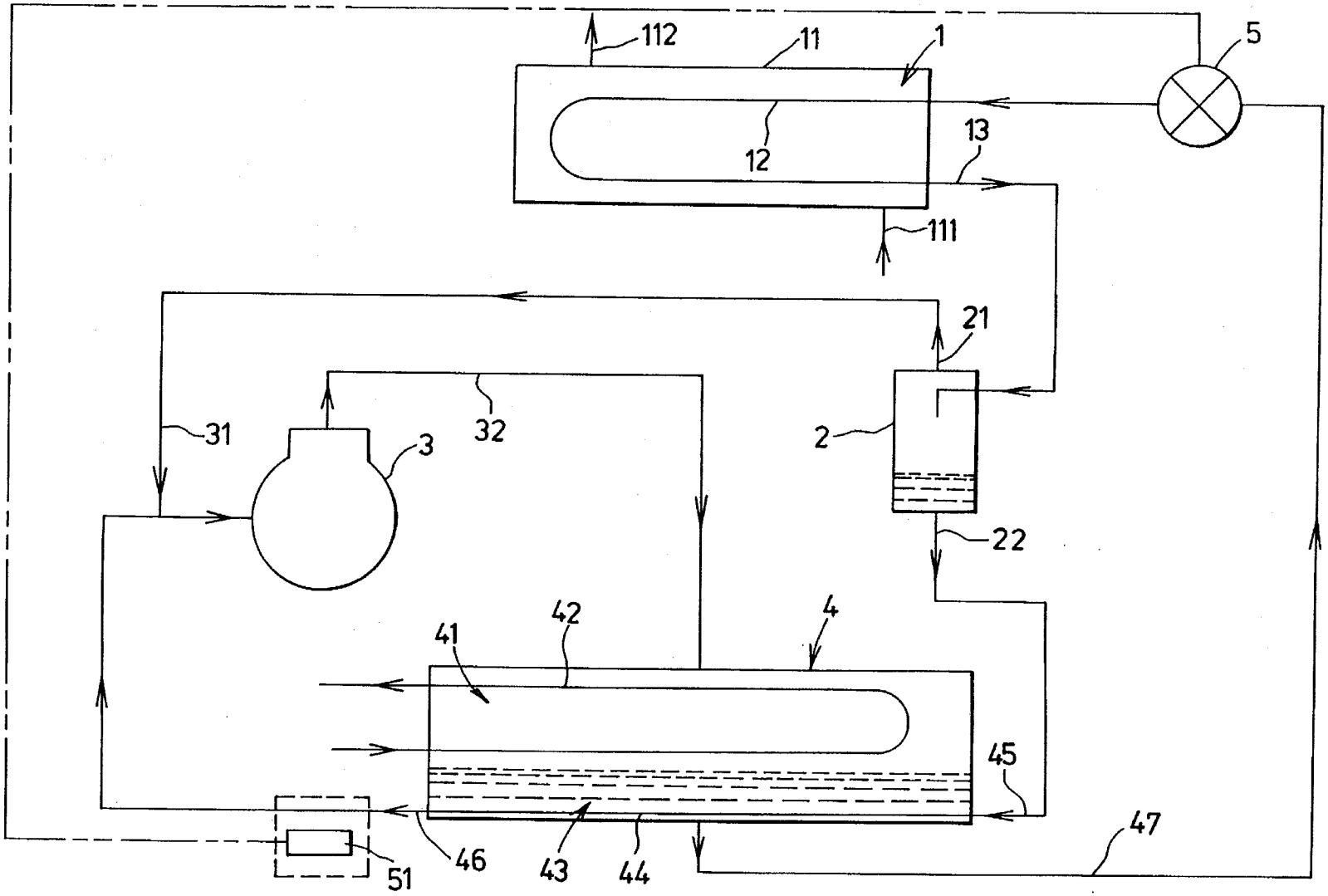
FIG. 2 is a system diagram of a preferred embodiment of the present invention.

As mentioned above, the present invention is suited for use in fluid chilling packages or the like employing cooling operations. Therefore, the inlet 111 and outlet 112 of the vessel 11 shown in FIG. 2 represent the respective entrance and exit for any substance such as water in a heat exchange relationship with the evaporator 1 in the vessel 11. The substance may enter into the evaporator 1 via inlet 111 to exchange heat with the refrigerant in the refrigerant conduit 12 and is then discharged via outlet 112. Hence, the vessel 11 may be a cold water container, or any other suitable container for the storage or passage of a fluid.

Similar to conventional direct expansion type refrigeration systems, the system according to the present invention comprises an evaporator 1, having a refrigerant conduit 12 disposed therein, a passage or vessel for a heat exchange substance in a heat exchange relationship with the refrigerant conduit 12; the heat exchange substance, as mentioned before, enters through the inlet 111 and is discharged through the outlet 112; a thermostatic expansion valve 5 with its outlet end thereof connected to an inlet of the refrigerant conduit 12 of the evaporator 1; a condenser 4 which is a specially designed heat exchange device connected to an inlet of the expansion valve 5; and a compressor 3 disposed in between the condenser 4 and the evaporator 1 and respectively connected to the condenser 4 and the evaporator 1 by conduit arrangements.

The system of the present invention further comprises a vapor/liquid separator 2 connected to an outlet segment 13 of the refrigerant conduit 12 of the evaporator 1. The separator 2 has an outlet segment 21 for vaporized refrigerant and an outlet segment 22 for oil-rich liquid refrigerant, wherein the vaporized refrigerant outlet segment 21 is connected to a suction line 31 of the compressor 3, and the oil-rich liquid refrigerant outlet segment 22 is connected to an inlet segment 45 of a secondary heat exchanger 43 in the condenser 4, thereby preventing oil-rich liquid refrigerant from being directly conveyed into the suction line 31 of the compressor 3.

In the present invention, by using a vapor/liquid separator, the refrigerant inside the refrigerant conduit 12 of the evaporator 1 does not have to be superheated and evaporated as in prior art; instead, the refrigerant is maintained in a two-phase state, so that the present invention provides a higher heat transfer efficiency than prior art.

Figure 3:
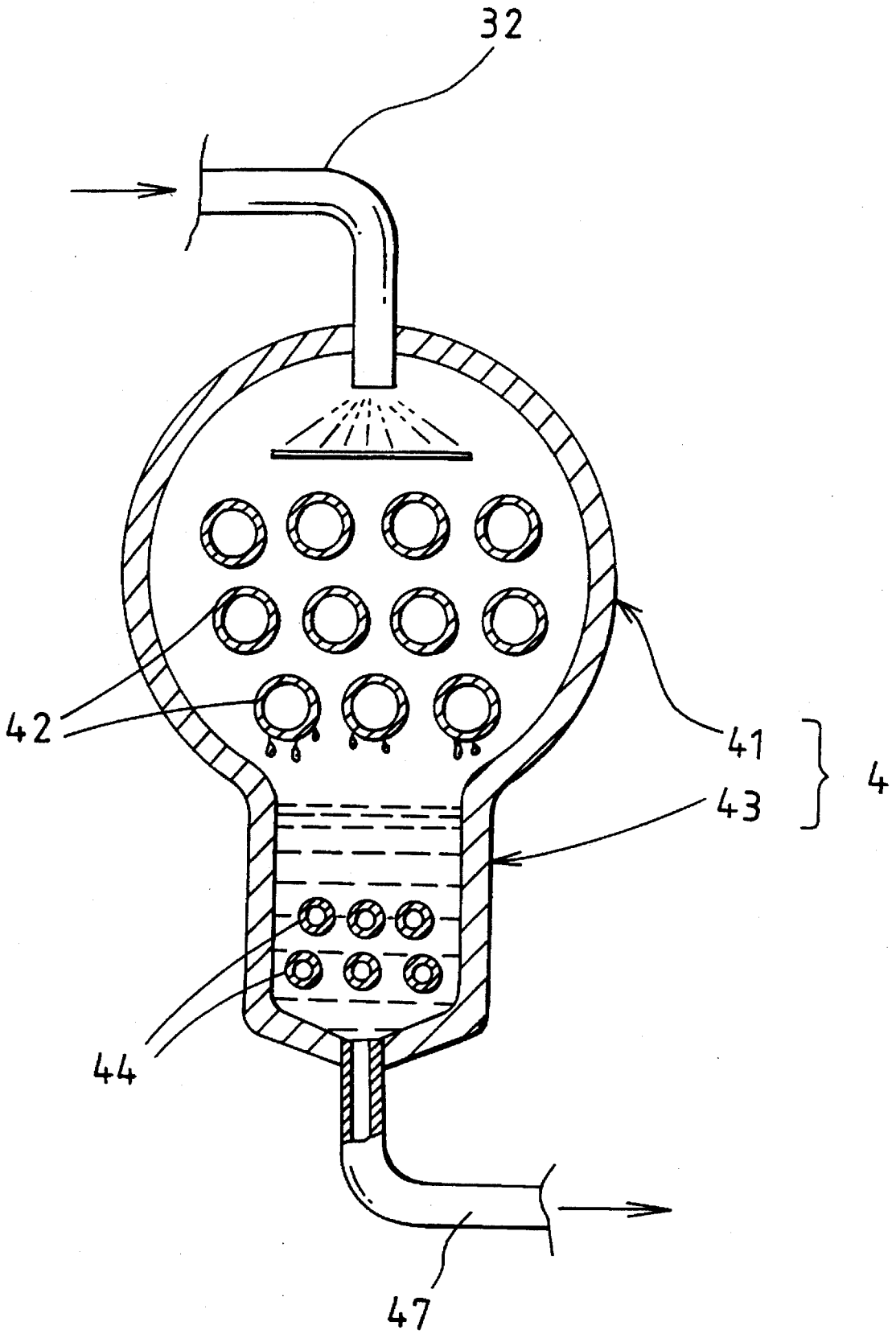
FIG. 3 is a sectional view taken along line 3—3 of FIG. 2.

With reference to FIGS. 2 and 3, the special condenser 4 employed in the present system includes a primary heat exchanger 41 and a secondary heat exchanger 43 located at the base of the primary heat exchanger 41, wherein the primary heat exchanger 41 may be a conventional condenser or a heat exchanger as shown in FIGS. 2 and 3, the heat exchanger having a plurality of cooling conduits 42 (FIG. 2 showing only one conduit). High-pressure refrigerant vapor discharged from the compressor 3 via an outlet segment 32 thereof is transported to the primary heat exchanger 41 to exchange heat with the cooling conduits 42 to become a saturated refrigerant liquid, then the saturated refrigerant liquid is conveyed into the secondary heat exchanger 43 to undergo a secondary heat exchange operation. The secondary heat exchanger 43 has a plurality of refrigerant conduits 44 (FIG. 2 showing only one conduit). Oil-rich liquid refrigerant transported from the vapor/liquid separator 2 is passed into each refrigerant conduit 44 via an inlet segment 45 to exchange heat with the saturated refrigerant liquid inside the secondary heat exchanger and the oil-rich liquid refrigerant in the refrigerant conduits 44 becomes vaporized and is transported to the suction line 31 of the compressor 3 via an outlet segment 46; the saturated refrigerant liquid becomes subcooled refrigerant liquid at the same time and is then sent to the expansion valve 5 via a conduit segment 47.

The temperature sensor 51 (such as a bulb or the like) of the expansion valve 5 used in the present system is for detecting the superheat at the outlet segment of the secondary heat exchanger 43 of the condenser 4 so as to regulate the refrigerant flow through the expansion valve 5 based on the change in superheat.

In the present system, the refrigerant is prevented from being superheated and completely evaporated, and it undergoes heat exchange in the form of a two-phase mixture of liquid and vapor to increase the heat transfer efficiency. The present system prevents liquid refrigerant from directly entering the compressor via the evaporator, and the present system enables the oil-rich liquid refrigerant from the vapor/liquid separator to become vaporized after heat exchange in the heat exchanger before being conveyed into the compressor; the process of vaporizatiion of the oil-rich liquid refrigerant leads to the rapid heat release of the saturated refrigerant liquid from the primary heat exchanger so that the refrigerant liquid becomes subcooled. In the present invention, the subcooled refrigerant liquid transported to the expansion valve 5 has a temperature lower than that in conventional systems without liquid-to-suction heat exchangers since the present system provides two heat exchange operations; this results in an increase in cooling capacity.

Although the present invention has been illustrated and described with reference to the preferred embodiments thereof, it should be understood that it is in no way limited to the details of such embodiments, but is capable of numerous modifications within the scope of the appended claims.

What is claimed is:

1. A method for operating a refrigeration system for use in fluid chilling packages or other equipment employing cooling operations, said method comprising:

maintaining a refrigerant passing through an evaporator from a thermostatic expansion valve in a two-phase state of saturated liquid and vapor;

separating saturated refrigerant liquid and vapor at an outlet of said evaporator into saturated refrigerant vapor and oil-rich refrigerant liquid;

conveying saturated refrigerant vapor to a suction line of a compressor and conveying oil-rich refrigerant liquid to a heat exchange device, evaporating oil-rich refrigerant liquid to become superheated vapor which is conveyed via said heat exchange device to said suction line of said compressor, and passing high pressure refrigerant vapor compressed by said compressor via said heat exchange device to become subcooled refrigerant liquid which is then sent to said thermostatic expansion valve.

2. A refrigeration system for use in fluid chilling packages or other equipment employing cooling operations, said system comprising:

an evaporator having a refrigerant inlet and a refrigerant outlet, refrigerant therein existing in a two-phase mixture of vapor and liquid which undergoes heat exchange in said evaporator;

a thermostatic expansion valve consisting of a temperature sensor, said expansion valve having an inlet and an outlet, wherein said outlet is connected to said refrigerant inlet of said evaporator;

a separator having a vapor outlet, a liquid outlet, and an inlet connected to said refrigerant outlet of said evaporator;

a compressor having an inlet and an outlet, wherein said inlet of said compressor is respectively connected to said vapor outlet of said separator and a low pressure refrigerant vapor outlet of a heat exchange device; and said heat exchange device, having a low pressure refrigerant liquid inlet connected to said liquid outlet of said separator, said low pressure refrigerant vapor outlet connected to said compressor inlet, a high pressure refrigerant vapor inlet connected to said outlet of said compressor, and a high pressure subcooled refrigerant liquid outlet connected to said inlet of said expansion valve, said low pressure refrigerant liquid inlet of said heat exchange device connected to said low pressure refrigerant vapor outlet of said heat exchange device to form a secondary heat exchanger so that fluid fed via said high pressure refrigerant vapor inlet of said heat exchange device transfers heat with said secondary heat exchanger and is then conveyed to said expansion valve via said high pressure subcooled refrigerant liquid outlet of said heat exchange device.

3. A refrigeration system as claimed in claim 2, wherein said secondary heat exchanger has a plurality of refrigerant conduits for the passage of oil-rich liquid refrigerant discharged from said separator.

4. A refrigeration system as claimed in claim 2, wherein said temperature sensor of said expansion valve is located at an outlet of said secondary heat exchanger for detecting the superheat at said outlet of said secondary heat exchanger to feedback to said expansion valve for regulating the mass flow rate of refrigerant therethrough.

5. A refrigeration system as claimed in claim 2, wherein said heat exchange device further comprises a primary heat exchanger located on top of said secondary heat exchanger.

6. A refrigeration system as claimed in claim 5, wherein said primary heat exchanger has a plurality of cooling conduits.

7. A refrigeration system as claimed in claim 5, wherein said primary heat exchanger is a condenser.

* * * * *